US009945631B2

(12) United States Patent
Chang et al.

(10) Patent No.: US 9,945,631 B2
(45) Date of Patent: Apr. 17, 2018

(54) TOOL AND METHOD FOR MODIFYING A MAGAZINE LOCK

(71) Applicant: Stage 5 Enterprises, LLC, Laguna Hills, CA (US)

(72) Inventors: Charles Chang, Laguna Hills, CA (US); Emil Chao, Studio City, CA (US)

(73) Assignee: Stage 5 Enterprises, LLC, Laguna Hills, CA (US)

( * ) Notice: Subject to any disclaimer, the term of this patent is extended or adjusted under 35 U.S.C. 154(b) by 0 days.

(21) Appl. No.: 15/653,474

(22) Filed: Jul. 18, 2017

(65) Prior Publication Data

US 2018/0017347 A1 Jan. 18, 2018

Related U.S. Application Data

(60) Provisional application No. 62/363,787, filed on Jul. 18, 2016.

(51) Int. Cl.

| | |
|---|---|
| ***F41A 35/00*** | (2006.01) |
| ***F41A 17/38*** | (2006.01) |
| ***F41A 17/36*** | (2006.01) |
| *F41C 7/00* | (2006.01) |

(52) U.S. Cl.

CPC ..... *F41A 17/38* (2013.01); *F41A 17/36* (2013.01); *F41A 35/00* (2013.01); *F41C 7/00* (2013.01)

(58) Field of Classification Search

CPC ..... F41A 3/66; F41A 35/00
USPC ..... 42/90, 106, 108
See application file for complete search history.

(56) References Cited

U.S. PATENT DOCUMENTS 9,009,986 B1 * 4/2015 Chang ..... F41A 3/66 33/640
2017/0209941 A1 * 7/2017 Chang ..... B23B 35/00

* cited by examiner

*Primary Examiner* — Reginald Tillman, Jr.
(74) *Attorney, Agent, or Firm* — Weide & Miller, Ltd.

(57) ABSTRACT

A firearm and a jig for modifying or constructing a firearm with a locking magazine release button is provided. The firearm has a lower receiver including a magazine locking pin aperture disposed in an upper surface thereof where the magazine locking aperture intersects with a magazine release button aperture in a side surface of the lower receiver. The firearm also has an upper receiver attached to the lower receiver via a pivot pin, a magazine attachable to the lower receiver, a magazine locking pin inserted into the magazine locking pin aperture, and a magazine release button comprising a recessed locking catch. The magazine release button releases the magazine when the upper receiver is away from the lower and the pin is not in the magazine locking aperture. The button is inoperable when the upper receiver is next to the lower receiver and the pin engages the locking catch.

6 Claims, 10 Drawing Sheets

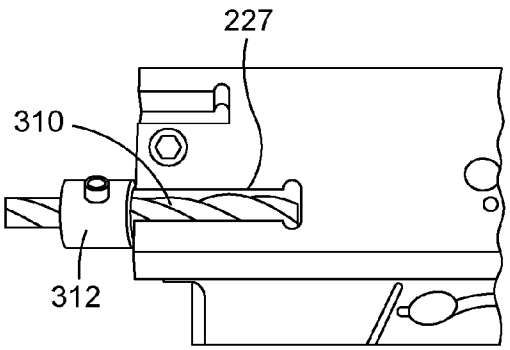
FIG. 3A
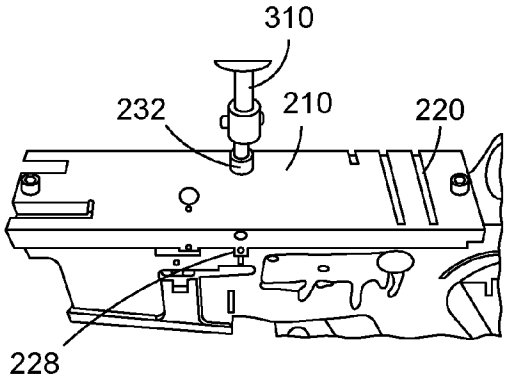
FIG. 3B
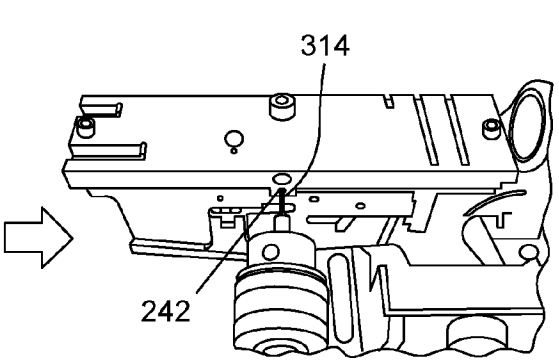
FIG. 3C
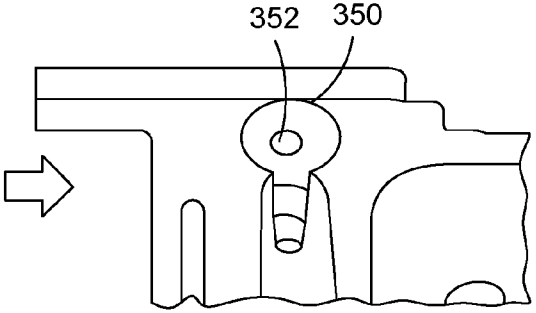
FIG. 3D
FIG. 3E

TOOL AND METHOD FOR MODIFYING A MAGAZINE LOCK

CROSS-REFERENCE TO RELATED APPLICATION

This application claims priority to U.S. Provisional Application No. 62/363,787 which was filed on Jul. 18, 2016, the contents of which are hereby incorporated by reference.

BACKGROUND

1. Field

The disclosed embodiments relate to firearms. More specifically the disclosed embodiments relate to methods and systems for modifying a magazine locking mechanism of a firearm, and a firearm with a locking magazine release.

2. Related Art

Laws and policy controlling the sale and transfer of firearms continue to evolve. Some jurisdictions have considered or have passed various regulations attempting to prevent firearms from being sold that would enable a criminal or terrorist to shoot multiple rounds of ammunition in a short period of time. Such laws are often politically controversial. However, the result is a demand to develop new firearms that comply with such regulations or to develop methods and systems to modify existing firearms so that such firearms are compliant with the regulations.

An example of such a regulation passed in California classifies weapons with magazine release button that allow for the quick removal and reinstallation of magazines as assault rifles. This includes magazine release buttons that require tools to operate. The regulation requires current owners of such weapons to register the firearm as a registered assault weapon (RAW). Transfer of a RAW under the regulations is prohibited, event in the event of death.

For a firearm to not be considered an assault rifle, the firearm's action must be open for the magazine to be released. One way this is done is for the firearm to be at least partially disassembled to remove the magazine.

Examples of firearms that have a magazine release button to remove a magazine include the popular AR-15 rifle, including the many variations on the AR-15 platform, and the AR-308. An example of an AR-15 rifle 100 is shown in FIGS. 1A and 1B. The rifle 100 has a magazine release button 102 that releases a magazine 104 for quick removal of the magazine 104 to quickly reinstall a new magazine 104. Thus, the typical AR-15 rifle would likely be considered an assault rifle under the California regulation.

Given the popularity of the AR-15, there are proposed methods of modifying the rifle to comply with the regulation. In these proposals, the rifle 100 is modified so that the magazine release button 102 is rendered inoperable until after the rifle 100 is disassembled such that the rifle cannot be fired. For example, the rifle is modified so that a magazine release button 102 will not work until a rear take down pin 108 is removed and the upper receiver 110 is pivoted away from the lower receiver 112 via the pivot pin 106.

In these previously proposed methods, the modifications to the gun may be considered unsightly. For example, the previous proposed modifications require a large, thick lever arm between the upper receiver and the magazine release button. Further, the required pivoting of the upper receiver with respect to the lower receiver for the magazine release button to enable is large, making the process awkward. Many of the proposed modifications also require epoxy to make the modified parts unremovable from the outside.

In some cases, the rifle will double feed. In this case, the bolt carrier group is partially locked back and one round is partially in the chamber, the second is either ½ in the mag and into the barrel area or inside of the gun. The safe way to clear this is to remove the magazine and drop out the extra rounds and to pull back the charging handle. Since the bolt is partially retracted, a user can't rotate the upper out of the way to clear the magazine release so a user has to clear this with the magazine in the firearm making it dangerous. In the other designs, the retracted or partially retracted bolt carrier group prevents the action from opening and releasing the magazine.

Accordingly, more convenient, safe, and attractive modifications are necessary to modify a rifle so that it can be compliant with such regulations.

SUMMARY

Accordingly, systems and methods for modifying a firearm, and a firearm design have been developed that safely and conveniently allow for disassembly of a firearm to disengage the action to allow a magazine to be release. In one embodiment, a jig for modifying a magazine release mechanism is provided. The jig includes mounting blocks that are releasably attached to a take-down pin and a pivot pin of a lower receiver of a firearm, and a base plate attached to the mounting blocks. The base plate includes a plurality of drill gauges, at least one drill guide aperture, a magazine release button recess that removably attaches to a magazine release button; and at least one drill guide that is removably inserted into the at least one drill guide aperture.

In some embodiments, the base plate also includes at least one locating feature to position the jig on the lower receiver of the firearm. The at least one locating feature may include a lip protruding from a bottom surface and/or a vertical extension projecting from the bottom surface. The vertical extension may be aligned with the at least one drill guide aperture and may include a set screw drill hole aperture that extends through the vertical extension parallel to the bottom surface.

In one embodiment, the magazine release button recess is formed on a bottom surface of the base plate and overlaps the at least one drill guide aperture. The magazine release button recess may have an oval shape.

In another embodiment, a speed cam is provided that is configured to replace a take-down pin of a firearm having a lower and an upper receiver. The speed cam includes a head disposed at a first end that has a projection that interfaces with a lever arm, an annular groove disposed adjacent to the head that has at least one detent, an intermediate cylindrical surface disposed adjacent to the annular groove, a terminal cylindrical surface disposed at a second end, and cam surfaces disposed between the intermediate cylindrical surface and the terminal cylindrical surface. The cam surfaces interface with the upper receiver to define an open position between the upper receiver and the lower receiver, a locked position between the upper receiver and the lower receiver, and a removable position between the upper receiver and the lower receiver.

In one embodiment, the cam surfaces include a locking cam surface having a radius similar to the intermediate cylindrical surface and the terminal cylindrical surface. The locking cam surfaces hold the upper receiver next to the lower receiver in a locked position. The cam surfaces may also comprise an open cam surface having a radius less than the intermediate cylindrical surface and the terminal cylindrical surface. This smaller radius allows the upper receiver to pivot away from the lower receiver. In this position, the action is disengaged and the magazine may be released from the firearm.

The speed cam may further include an axial groove extending through the intermediate cylindrical surface and into the terminal cylindrical surface. The axial groove comprises a stop detent disposed toward the second end. The axial groove allows the speed cam to be pulled out to clear the upper receiver, allowing the upper receiver to be fully disassembled from the lower receiver.

In yet another embodiment, a firearm with a locking magazine release button is provided. The firearm includes a lower receiver having a magazine locking pin aperture on a top surface that extends to intersect with a magazine release button aperture in a side surface. An upper receiver is attached to the lower receiver via a pivot pin where the upper receiver may pivot relative to the lower receiver via the pivot pin.

A magazine is provided that releasably attaches to the lower receiver, and a magazine locking pin is included that is inserted into the magazine locking pin aperture. A magazine release button is disposed in the magazine release button aperture and includes a recessed locking catch. The magazine release button releases the magazine when the upper receiver is pivoted away from the lower receiver and the magazine locking pin does not extend into the magazine locking aperture. The magazine release button is inoperable to release the magazine when the upper receiver is next to the lower receiver and the magazine locking pin extends into the magazine locking aperture and engages the recessed locking catch.

In some embodiments, the firearm further comprises a take-down pin connecting the upper receiver and the lower receiver. The take-down pin locks the upper receiver to the lower receiver and prevents the upper receiving from pivoting away from the lower receiver. The magazine locking pin includes a large diameter portion and a small diameter portion, and a spring disposed within the magazine locking pin aperture biases the magazine locking pin out of the magazine locking pin aperture.

The magazine locking pin aperture may include a threaded hole in a sidewall thereof. The magazine locking pin may include a u-shaped recess defining a locking seat. A set screw disposed in the threaded hole engages the locking seat to lock the magazine locking pin within the magazine locking pin aperture. The firearm may include a speed cam as described above.

The firearm results in a locking and unlocking magazine release button that can release the magazine when the action is open a small amount where the bolt carrier group is partially or fully retracted. Legal magazine changes are facilitated when the bolt carrier group is fully retracted and held in place by the bolt catch.

BRIEF DESCRIPTION OF THE DRAWINGS

FIG. 3A, FIG. 3B, FIG. 3D, FIG. 3D, and FIG. 3E show steps of using a jig for modifying magazine locking mechanism, according to an exemplary embodiment.

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Described below are jigs, methods, and systems for modifying a firearm to have a locked magazine until an action of the firearm is disengaged. Reference is made throughout the specification and figures to an AR-15 rifle to facilitate explanation. However, the jigs, methods, and systems may be applied to several other weapons systems and are not limited to the AR-15.

Figure 2A:
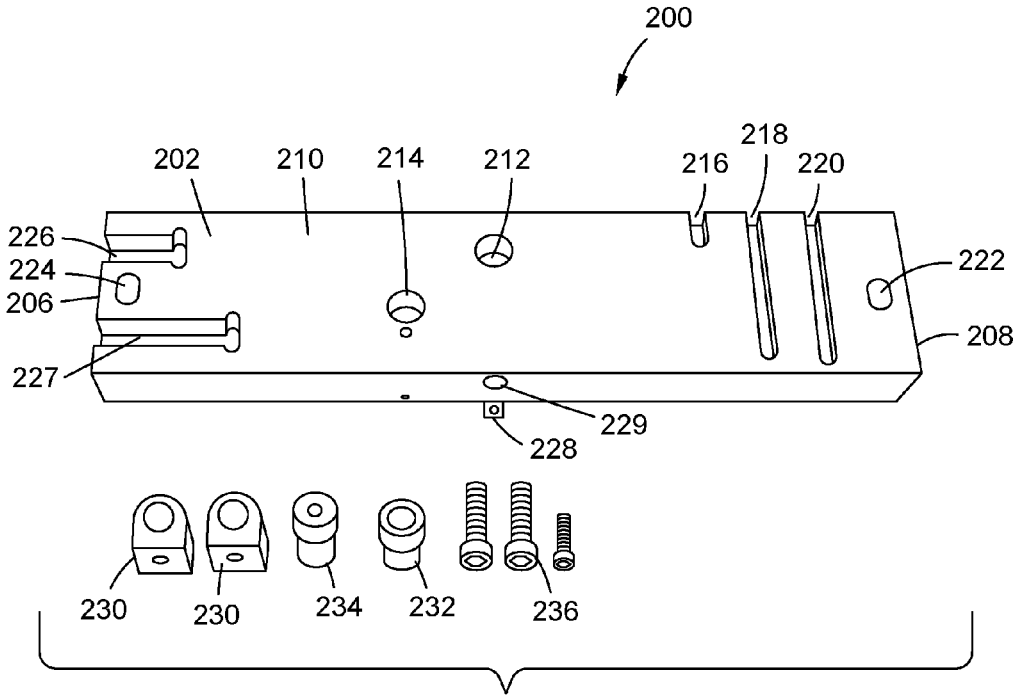
FIG. 2A shows an unassembled view of a jig for modifying a magazine locking mechanism.
Figure 2B:
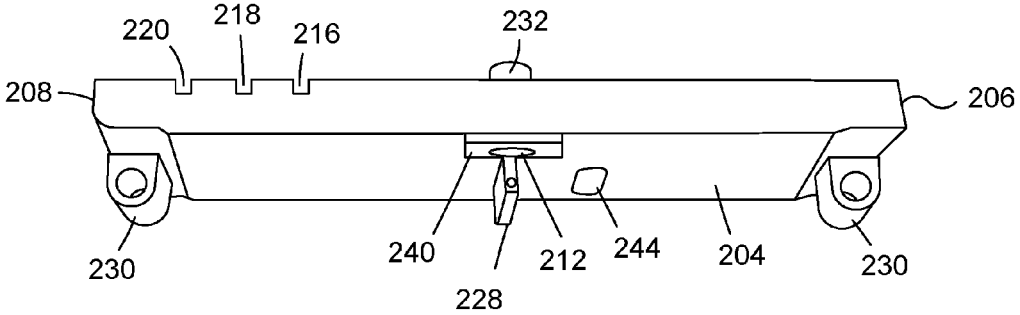
FIG. 2B shows an assembled view of the jig in FIG. 2A.

FIG. 2A shows an unassembled view of a jig for modifying a magazine locking mechanism, and FIG. 2B shows an assembled view of the jig in FIG. 2A. A magazine locking assembly modification jig 200 is comprised of a baseplate 210 having a top side 202, a bottom side 204, a first end 206, and a second end 208. The base plate 210 comprises several features to enable modification of a firearm, such as an AR-15 rifle.

The base plate 210 comprises drill guide holes that provide templates for modifying parts of the rifle. A magazine lock pin guide hole 212 is disposed on a center portion of the base plate 210 and extends through from the top side 202 to the bottom side 204. A magazine lock catch guide hole 214 is also provided extending from the top side 202 to the bottom side 204.

On the top side 202 of the base plate 210, a first depth gauge 216, a second depth gauge 218, and a third depth gauge 220 are provided. These depth gauges 216, 218, 220 accurately set drill depths for modified features of the rifle as will be discussed in more detail below. The depth gauges 216, 218, 220 extend from a lateral edge of the base plate 210 and are disposed towards the second end 208.

Figure 1A:
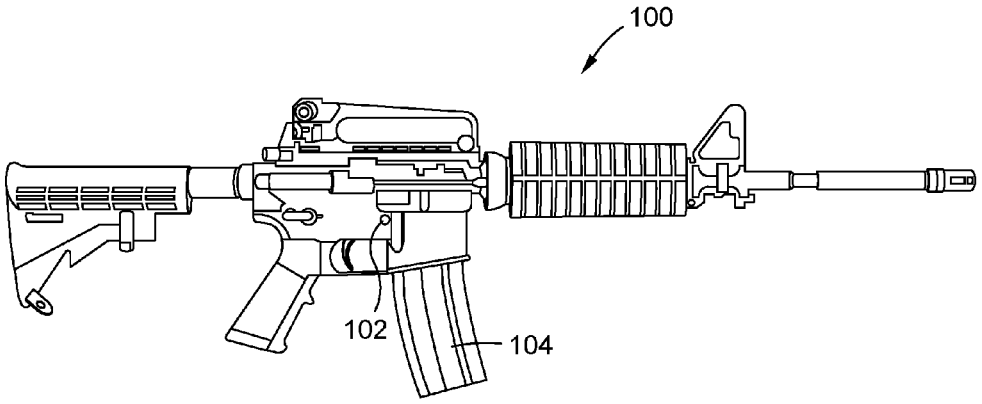
FIG. 1A (Prior Art)
FIG. 1A and FIG. 1B show an exemplary rifle.
Figure 1B:
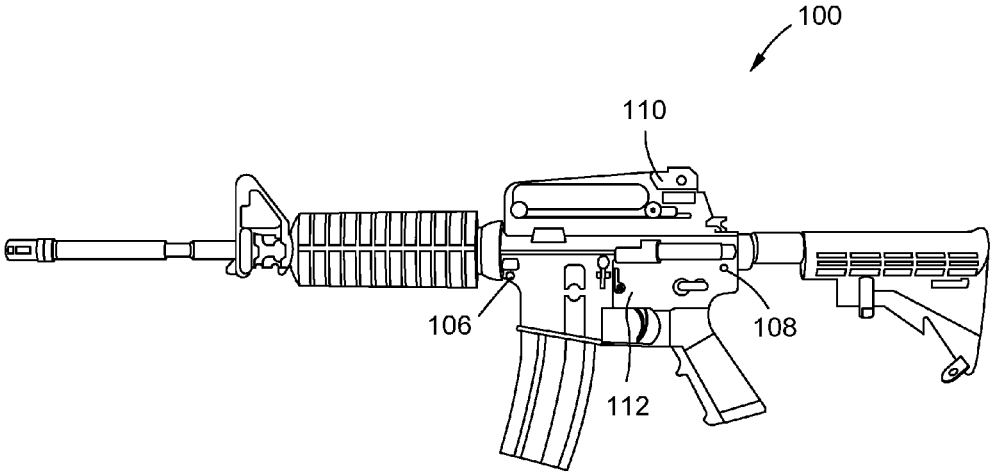
FIG. 1B (Prior Art)

Additional depth gauges 226, 227 extend on the top side 202 of the base plate 210 from the first end. These depth gauges 226, 227 accurately set drill depths for other modified features of the rifle as discussed below. Apertures 222, 224 are provided to attach mounting blocks 230, as shown in FIG. 2B. The apertures 222, 224 are formed in an oval shape to accommodate a universal fit to several gun types. The mounting blocks 230 are configured to reference the jig 200 to a lower receiver of a rifle. Here, the mounting blocks 230 mount to the pivot pin and take down pin of an AR-15 rifle (see pivot pin 106 and takedown pin 108 in FIG. 1B). A width of the jig 200 is formed to be wider than the lower receiver so that the jig can be held in in a clamping device, such as a vise, to facilitate work on the lower receiver.

The base plate 210 further comprises a vertical extension 228 that projects downward from the bottom side 204. This feature further helps to orient the base plate 210 relative to the lower receiver of the rifle. Aperture 229 may be threaded and provides access to the magazine lock pin guide hole 212 to lock drill guides 232, 234 within the hole 212. Fasteners 236 are provided to attach the mounting blocks 230 and fix the drill guides 232, 234. The base plate also has a lip 240 projecting slightly from the bottom side 204 to reference the jig 200 to the lower receiver to provide the correct spacing between the lower receiver and the jig 200. The combination of the mounting blocks 230, the vertical extension 228 and lip 240 ensures the correct positioning of the jig 200 in each of the x-, y-, and z-directions (the x-direction referring to the direction from the first end 206 to the second end 208, the y-direction referring to a direction perpendicular to the x-direction and parallel with the top side 202 and bottom side 204 of the base plate 210, and the z-direction referring to a direction perpendicular to a plane defined by the top side 202 and the bottom side 204 of the base plate 210) as well as at the correct rotation position.

FIG. 3A, FIG. 3B, FIG. 3D, FIG. 3D, and FIG. 3E show steps of using a jig for modifying a lower receiver to accommodate a magazine locking mechanism, according to an exemplary embodiment. After the jig 200 is attached to the lower receiver of the rifle, a hole to facilitate a magazine locking pin may be drilled. As shown in FIG. 3A, a drill bit 310 is placed in the drill bit depth gauge 227 to set a drill stop 312 to control a drill depth for the drill bit 310. In FIG. 3B, the drill bit 310 is inserted into the first drill guide 232 to drill a hole with a first width in the lower receiver to accommodate the magazine locking pin. The first drill guide 232 is then replaced with the second drill guide 234 (see FIG. 3C), and a hole for the magazine locking pin is extended with a second width that is narrower than the first width. The depth of the extended part of the hole is set by the third depth gauge 220. This forms a spring seat within the magazine locking pin hole, as will be explained in more detail below.

A retaining screw hole is formed on a side of the magazine locking pin hole by setting a drill depth of a drill bit 314 using the second drill gauge 218 as shown in FIG. 3C. The vertical extension 228 of the base plate 210 further comprises a transverse hole 242 through which the drill bit 314 is inserted as shown in FIG. 3D to drill the retaining screw hole. After the retaining screw hole is formed, it is tapped with female threads. FIG. 3E shows a resulting magazine locking pin hole 350 with the retaining screw hole 352. As mentioned above, the pin hole 350 has a larger upper diameter and a smaller lower diameter that form a spring seat.

Figure 4B:
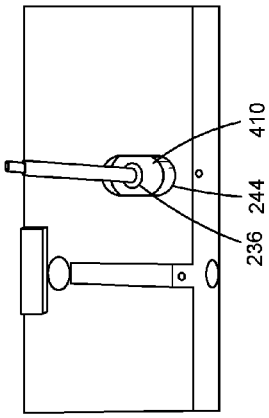
FIG. 4A, FIG. 4B, FIG. 4C, FIG. 4D, FIG. 4E, and FIG. 4F show steps of using a jig for modifying a magazine release button, according to an exemplary embodiment.
Figure 4A:
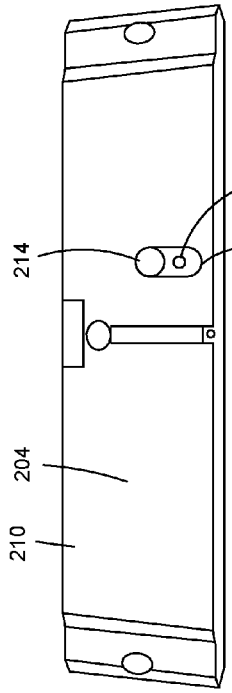

FIG. 4A, FIG. 4B, FIG. 4C, FIG. 4D, FIG. 4E, and FIG. 4F show steps of using a jig for modifying a magazine release button, according to an exemplary embodiment. As shown in FIG. 4A, the base plate 210 comprises a recessed oval 244 in the bottom surface 204. The recessed oval 244 is located to at least partially overlap with the magazine lock catch guide hole 214. A threaded screw hole 246 is disposed in the base plate 210 within the recessed oval 244.

Figure 4D:
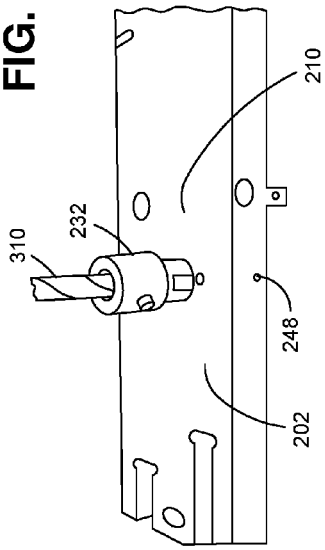
Figure 4C:
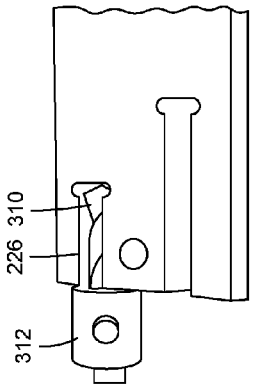
Figure 4F:
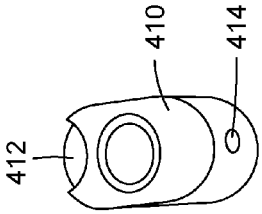
Figure 4E:
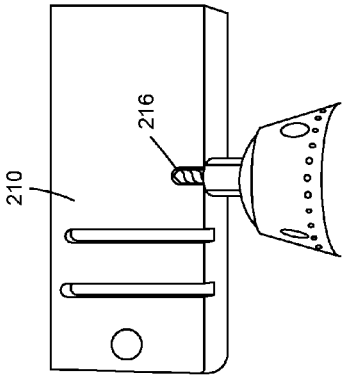

In FIG. 4B, a magazine release button 410 fits within the recessed oval 244 and is fastened to the base plate 210 via a fastener 326. Drill bit 310 is set to a drill depth via the drill gauge 226 with the drill stop 312 as shown in FIG. 4C. In FIG. 4D, the drill guide 232 is placed in the magazine lock catch guide hole 214. The drill bit 310 at the set drill depth machines out a locking catch 412 in the release button 410 (FIG. 4F). A drill depth for a second drill bit is set via the first drill gauge 216 as shown in FIG. 4E. Using hole 248 as a guide, a set screw hole 414 is formed in the magazine release button 410 (FIG. 4F). This hole is tapped with female threads to receive a set screw.

Figure 5:
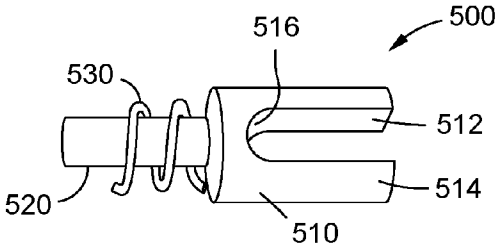
FIG. 5 shows a magazine locking pin, according to one exemplary embodiment.

FIG. 5 shows a magazine locking pin, according to one exemplary embodiment. A magazine locking pin 500 comprises a large diameter portion 510 and a small diameter portion 520. A spring 530 is disposed over the small diameter portion 520 and abuts against the large diameter portion 510. In use, the spring is placed into the pin hole 350 and is seated on the spring seat to bias the large diameter portion 510 away from the spring seat. The large diameter portion 510 has a u-shaped recess 512 formed therein forming two extensions 514 and a locking seat 516 at the bottom of the u-shaped recess 512.

Figure 6B:
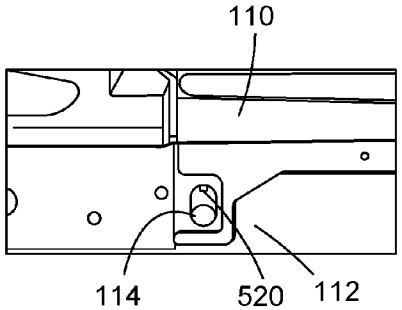
FIG. 6A, FIG. 6B, FIG. 6C, and FIG. 6D show assembly steps of adding a magazine locking pin to a firearm, according to an exemplary embodiment.
Figure 6C:
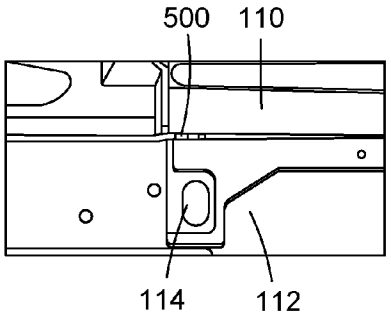
Figure 6A:
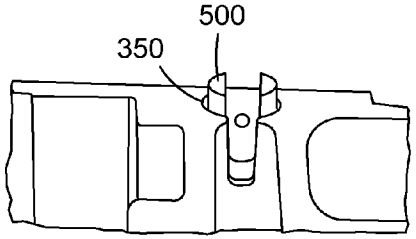

FIG. 6A, FIG. 6B, FIG. 6C, and FIG. 6D show assembly steps of adding a magazine locking pin to a firearm, according to an exemplary embodiment. In FIG. 6A, the magazine locking pin 500 is inserted into the magazine locking pin hole 350. The spring 530 biases the pin 500 out of the hole as explained above. FIG. 6B shows an upper receiver 110 and a lower receiver 112 in an assembled position where the upper receiver 110 is directly adjacent to the lower receiver 112. The lower receiver comprises a magazine release button aperture 114. In this position, the upper receiver 110 forces the pin 500 down so that the extensions 514 are flush with the top of the lower receiver 112. The small diameter portion 510 of the pin 500 extends into the magazine release button aperture 114 via the small diameter portion of the pin hole 350.

Figure 6D:
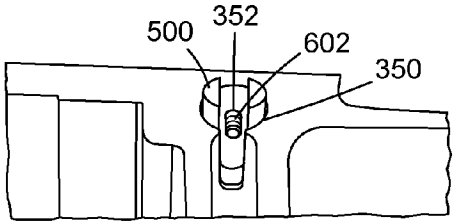

When the upper receiver 110 is pivoted away from the lower receiver 112, the spring biases the pin 500 upwards so that the small diameter portion 510 no longer protrudes into the magazine release button aperture 114. As shown in FIG. 6D, a set screw 602 within the hole 352 of the magazine locking pin hole 350 engages the locking seat 516 to lock the pin 500 within the hole 350 preventing the pin 500 from falling out when upper receiver 110 is pivoted away from the lower receiver 112. For example, when the pin 500 is biased out of the hole 350 by the spring 530, the set screw 602 comes into contact with the locking seat 516 to prevent further movement of the pin 500 out of the hole 350. This screw 602 also prevents the rotation of the pin 500 within the hole 350.

Figure 7A:
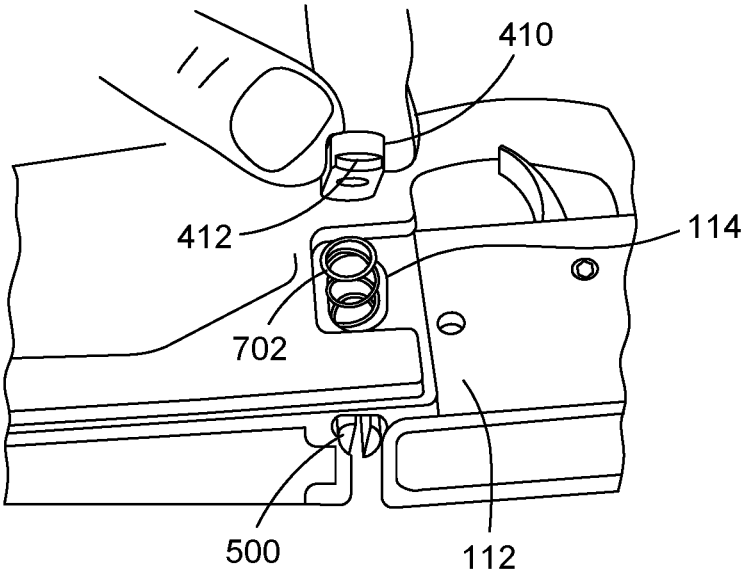
FIG. 7A and FIG. 7B show installation of a modified magazine locking button, according to one exemplary embodiment.
Figure 7B:
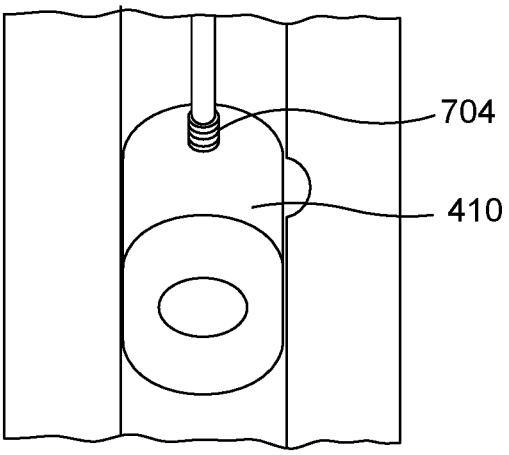

FIG. 7A and FIG. 7B show installation of a modified magazine locking button, according to one exemplary embodiment. The magazine release button 410 is inserted and secured into the magazine release button aperture 114. The magazine release button 410 may be biased towards the outside of the lower receiver 112 via a spring 702. The locking catch 412 is positioned on the upward side of the magazine release button aperture 114 to interface with the pin 500. To ensure a good fit and interaction between the locking catch 412 and the pin 500, a set screw 704 may be used as shown in FIG. 7B. The adjustment of the set screw as shown in FIG. 7B ensures that the locking catch 412 is correctly positioned at the top side of the magazine release button aperture 114 and eliminates excessive play between the magazine release button and the magazine release button aperture 114.

Figure 8A:
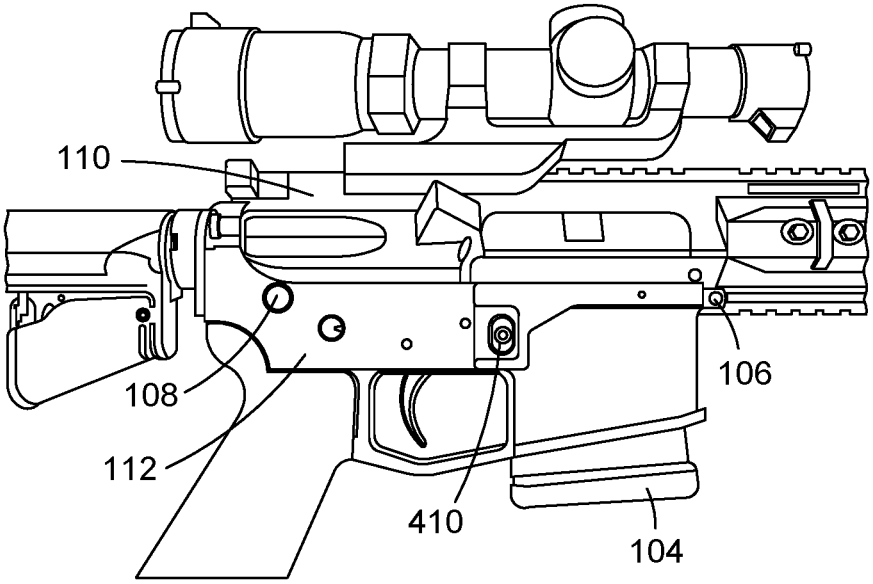
FIGS. 8A and 8B show operation of a firearm with a modified magazine lock, according to an exemplary embodiment.
Figure 8B:
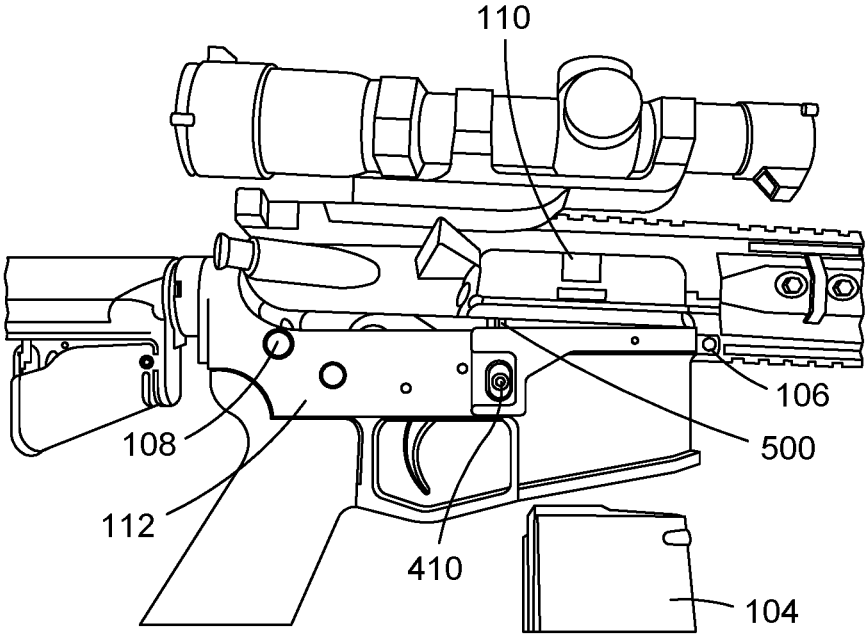

FIGS. 8A and 8B show operation of a firearm with a modified magazine lock, according to an exemplary embodiment. In FIG. 8A, the upper receiver 112 is locked next to the lower receiver 110 by the take down pin 108. In this position, the pin 500 interacts with the locking catch 412, preventing the magazine 104 from releasing from the lower receiver 112. When the take-down pin 108 is removed as shown in FIG. 8B, the upper receiver 110 may rotate about the pivot pin 106. The pin 500 moves upward and the magazine release button 410 may be actuated to release the magazine 104.

Figure 9A:
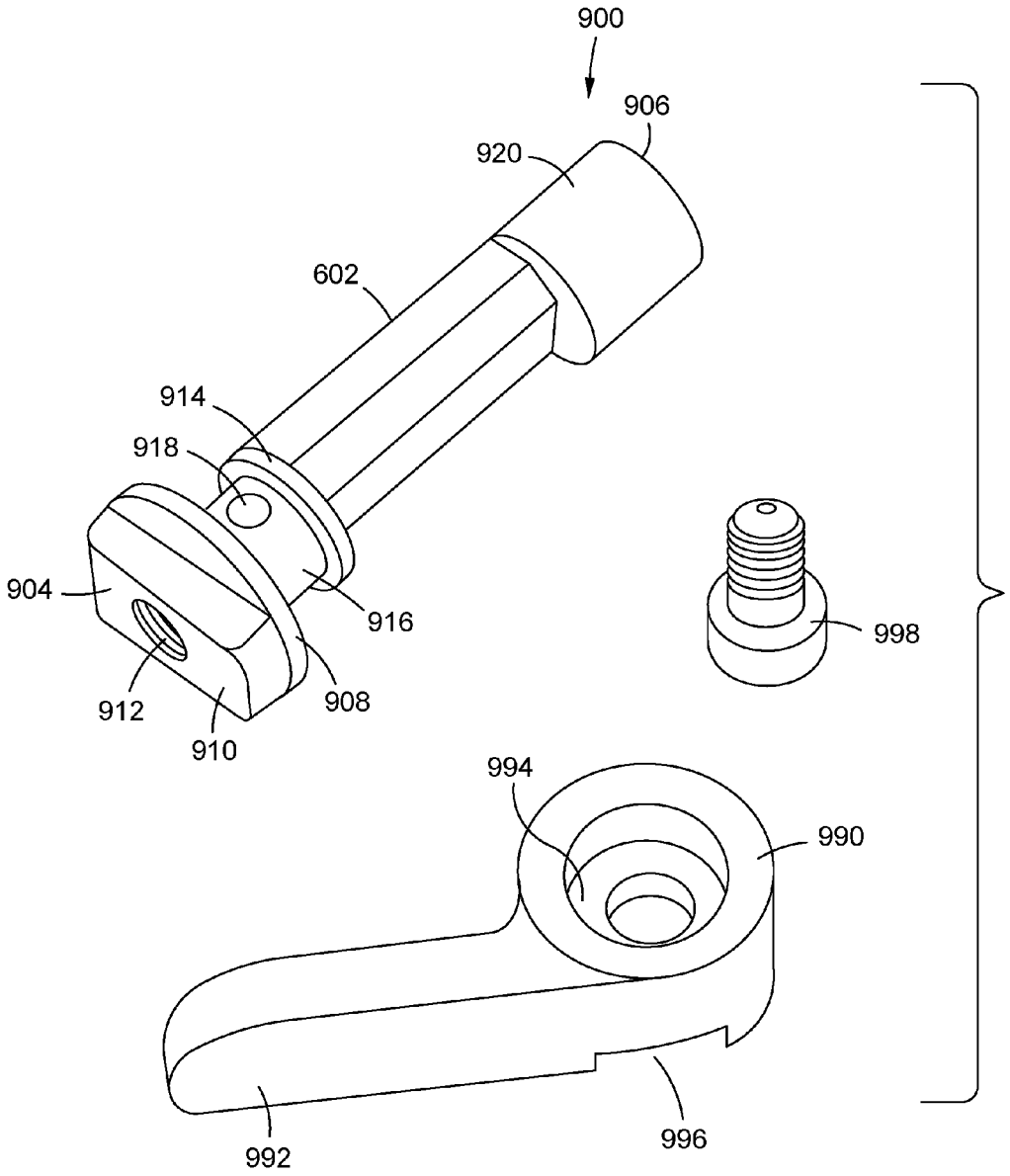
FIG. 9A, FIG. 9B, and FIG. 9C show a speed cam assembly, according to an exemplary embodiment.
Figure 9B:
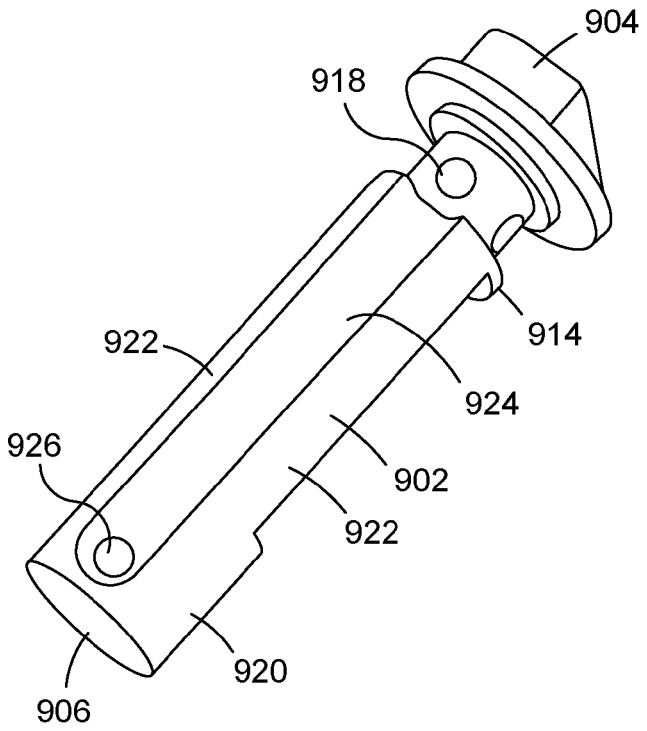
Figure 9C:
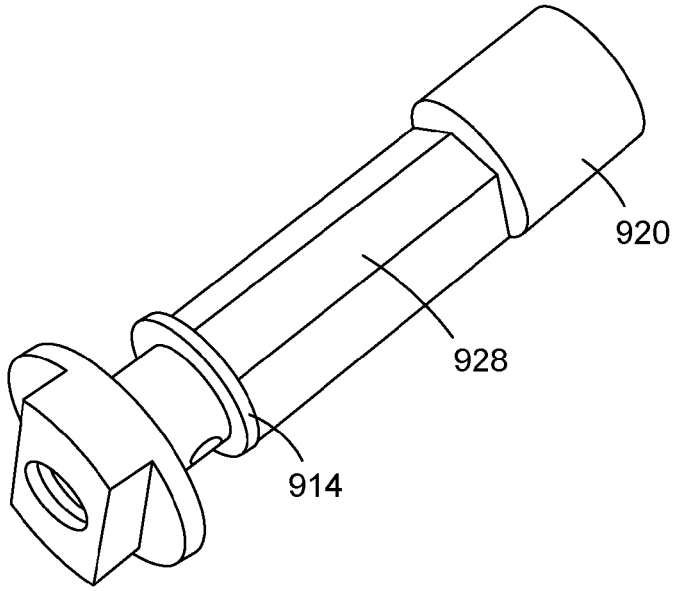

FIG. 9A, FIG. 9B, and FIG. 9C show a speed cam assembly, according to an exemplary embodiment. In FIG. 9A, a speed cam assembly 900 includes a speed cam 902, a lever arm 990, and fastener 998. The speed cam 902 has a first end 904 and a second end 906. At a first end 904 of the speed cam, a speed cam head 908 is provided with a projection 910 for applying a torque to the speed cam 902. The projection 910 comprises a threaded aperture 912 by which the fastener 998 secures the lever arm 990 to the speed cam 900.

The lever arm 990 comprises an arm portion 992 and an aperture 994 through which the fastener 998 may pass. The lever arm 900 further comprises a slot 996 on a rear side that engages the projection 910 so that a force applied on the arm portion 992 is transferred to the projection 910 to rotate the speed cam 902.

The first end 904 of the speed cam 902 further comprises an annular groove 916 between an intermediate cylindrical surface 914 and the head 908. The annular groove 916 comprises three detents 918. The annular groove 916 and detents 918 engage a projection or pin found in the upper receiver 112 of a firearm that typically engages with a conventional take down pin 108. The three detents 918 define three annular positions of the speed cam: a locked position, an open position, and removable position. The detents 918 provide tactile feedback to a user so that the user can feel when the speed cam assembly 900 is in one of the locked, open, and removable positions. The annular groove 916 allows the speed cam 902 to rotate with the pin of the upper receiver being held within the annular groove 915 by the head 908 and the intermediate cylindrical surface 914. This allows rotation of the speed cam 902 but prevents the removal of the speed cam 902.

On the second end 906 of the speed cam 902, a terminal cylindrical surface 920 is provided. The intermediate cylindrical surface 914 and terminal cylindrical surface 920 allow the speed cam to rotate within standard apertures of an upper and lower receiver 110, 112 that receive the take down pin 108.

In FIG. 9B, locking cam surfaces 922 are provided that have a radius similar to the terminal cylindrical surface 920. The locking cam surfaces 922 interact with the upper receiver 110 to secure the upper receiver when the speed cam is rotated to the locked and closed position. When the speed cam 902 is rotated to the removable position, the projection of the upper receiver 110 aligns with the detent 918 adjacent to a groove 924. The groove allows the speed cam 902 to be removed like a conventional take-down pin 108. An additional detent 926 is provided at the end of the groove 924 on the second end 906 of the speed cam 902. This gives tactile feedback to the user that the speed cam 902 has cleared the upper receiver 110 for disassembly.

FIG. 9C shows open cam surfaces 928. The open cam surface 928 have a radius less than the radius of the intermediate cylindrical surface 914 and the terminal cylindrical surface 920. The smaller radius allows the upper receiver 110 to pivot away from the lower receiver 112 when the speed cam is rotated to the open position.

Figure 10A:
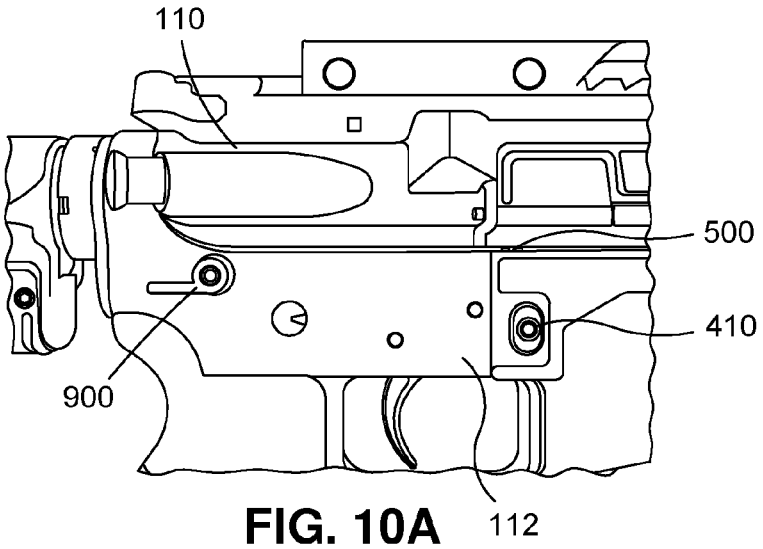
FIG. 10A, FIG. 10B, and FIG. 10C show operation of a speed cam assembly, according to an exemplary embodiment.
Figure 10B:
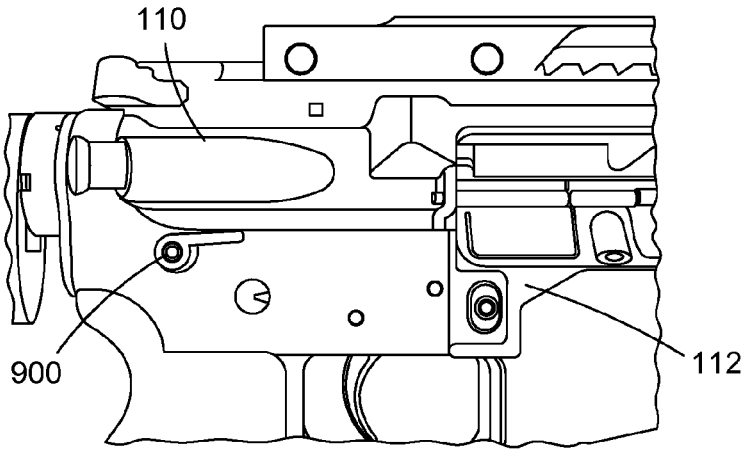
Figure 10C:
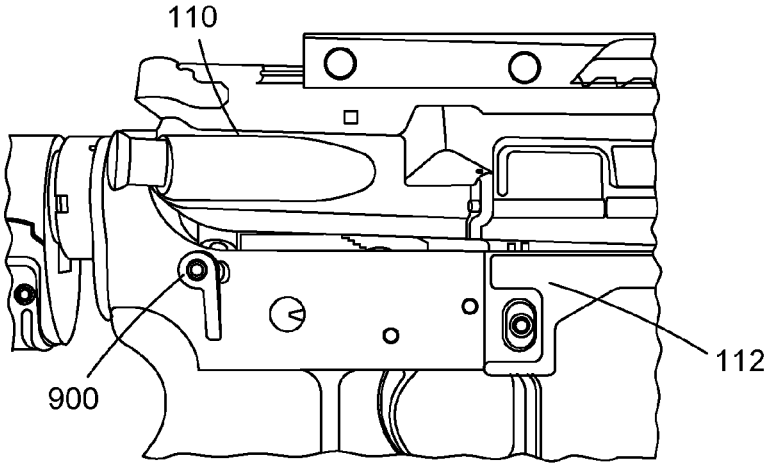

FIG. 10A, FIG. 10B, and FIG. 10C show operation of a speed cam assembly, according to an exemplary embodiment. In FIG. 10A, the speed cam assembly 900 is rotated to the open position. In this position, the speed cam 902 allows the upper receiver 110 to rotate slightly away from the lower receiver 112. This allows the pin 500 to raise so that the magazine release button 410 may operate to release the magazine 104. Though the rotation shown is slight, it is sufficient for the action of the firearm to be disengaged and for the pin 500 to no longer interface with the locking catch 412 of the release button.

In FIG. 10B, the speed cam assembly 900 is rotated to the locked position. In this position, the upper receiver 110 is held firmly against the lower receiver 112. In FIG. 10C, the speed cam assembly 900 is rotated to the removable position and is pulled out to clear the upper receiver 112 allowing the upper receiver 112 to be completely disassembled from the lower receiver 110. Thus, a user can conveniently operate the firearm.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A jig for modifying a magazine release mechanism, the jig comprising:

mounting blocks that are configured to be releasably attached to a takedown pin and a pivot pin of a lower receiver of a firearm;

a base plate attached to the mounting blocks, the base plate being sized and configured such that when the base is mounted on the lower receiver the mounting blocks are aligned with the take-down pin and pivot pin, respectively, the base plate comprising: a plurality of drill gauges; at least one drill guide aperture; and a magazine release button recess that is configured to be removably attached to a magazine release button; and at least one drill guide that is removably inserted into the at least one drill guide aperture.

2. The jig of claim 1, wherein the base plate further comprising at least one locating feature to position the jig on the lower receiver of the firearm with reference to at least one direction.

3. The jig of claim 2, wherein the at least one locating feature comprises one or more of a lip protruding from a bottom surface and a vertical extension projecting from the bottom surface that locate the jig in an x-direction extending from a first end to a second end of the base plate and a y-direction perpendicular to the x-direction.

4. The jig of claim 3, wherein the vertical extension is aligned in the y-direction with the at least one drill guide aperture and comprises a set screw drill hole aperture that extends through the vertical extension in the y-direction.

5. The jig of claim 1, wherein the magazine release button recess is formed on a bottom surface of the base plate and overlaps the at least one drill guide aperture.

6. The jig of claim 1, wherein the magazine release button recess has an oval shape.

* * * * *